US007300300B2

(12) United States Patent
Meijer et al.

(10) Patent No.: US 7,300,300 B2
(45) Date of Patent: Nov. 27, 2007

(54) CONNECTOR SYSTEM WITH IMPROVED UNPLUGGING FUNCTIONALITY

(75) Inventors: Marcel Peter Meijer, 's-Hertogenbosch (NL); Peter Poorter, Wijk en Aalburg (NL); Paul Johannes Marinus Potters, Eindhoven (NL)

(73) Assignee: FCI, Versailles (FR)

( * ) Notice: Subject to any disclaimer, the term of this patent is extended or adjusted under 35 U.S.C. 154(b) by 0 days.

(21) Appl. No.: 10/578,423

(22) PCT Filed: Nov. 5, 2004

(86) PCT No.: PCT/EP2004/012632

§ 371 (c)(1),
(2), (4) Date: May 4, 2006

(87) PCT Pub. No.: WO2005/046007

PCT Pub. Date: May 19, 2005

(65) Prior Publication Data

US 2007/0049099 A1 Mar. 1, 2007

(30) Foreign Application Priority Data

Nov. 24, 2003 (NL) ..... 1024850

(51) Int. Cl.
*H01R 13/62* (2006.01)

(52) U.S. Cl. ..... 439/372

(58) Field of Classification Search ..... 439/350–358, 439/372

See application file for complete search history.

(56) References Cited

U.S. PATENT DOCUMENTS

| | | | | |
|---|---|---|---|---|
| 6,093,057 | A * | 7/2000 | Lok | 439/607 |
| 6,450,830 | B1 * | 9/2002 | Koseki | 439/352 |
| 2004/0023546 | A1 * | 2/2004 | Wu | 439/352 |

FOREIGN PATENT DOCUMENTS

| | | |
|---|---|---|
| DE | 15 90 311 | 6/1970 |
| FR | 2 734 952 | 12/1996 |

* cited by examiner

*Primary Examiner*—Ross Gushi
(74) *Attorney, Agent, or Firm*—Harrington & Smith, PC

(57) ABSTRACT

The invention relates to a connector system of a connector and a counterpart. The connector includes a pivotally supported locking arm extending towards said counterpart, wherein said locking arm includes a first locking portion adapted to engage with a second locking portion of said counterpart by a first rotating movement (R1) of said locking arm to a locked position to lock said connector and said counterpart and to disengage from said second locking portion by a second rotating movement (R2) to an unlocked position to unlock said connector and said counterpart. The system is adapted to support said locking arm after said second rotating movement (R2) to prevent said locking arm to rotate backwards to said locked position. The invention further relates to a method for unplugging such a connector and a counterpart.

31 Claims, 12 Drawing Sheets

18
16
31
17
B
30
23A
23
33A
32
22
33

33
33A
16
23A 11
10
14
15

R2
S
3
16
18
17
15
34
22
32
23

CONNECTOR SYSTEM WITH IMPROVED UNPLUGGING FUNCTIONALITY

The invention relates to a connector system for the purpose of signal transfer with improved unlocking functionality. More specifically the invention relates to a connector system of a connector and a counterpart, said connector comprising a pivotally supported locking arm extending towards said counterpart, wherein said locking arm comprises a first locking portion adapted to engage with a second locking portion of said counterpart by a first rotating movement of said locking arm to a locked position to lock said connector and said counterpart and to disengage from said second locking portion by a second rotating movement to an unlocked position to unlock said connector and said counterpart.

Nowadays, cable connectors in e.g. telecom applications have to meet a package of ever increasing requirements relating to e.g. robustness, quality of assembly, aesthetical considerations, density, shielding etc.

U.S. Pat. No. 4,702,542 discloses a two-part housing of a cable connector that may mate and latch with a connector held in another housing. A pivotally supported spring loaded latching arm is provided to lock the cable connector to the mating connector housing or to a cut-out in a chassis or panel.

A problem associated with the prior art connector system is that unplugging of the cable connector is relatively complicated as an operator is required to first unlock the cable connector by actuating the latch by exerting an appropriate force exceeding the spring load and subsequently unplugging the cable connector while still exerting the force to the latch. If the unplugging operation is not performed immediately after unlocking, the cable connector locks again as a result of the spring load on the locking arm.

Connector panels in telecom applications typically have hundreds of such connector systems, such that repeated unplugging of the connector systems by such a complicated action is ergonomically problematic. Further, for a panel having a high density of cable connectors, often the unplugging operation is difficult because of lack of space.

It is an object of the invention to provide a connector system with an improved unplugging functionality.

This object is achieved by providing a connector system characterized in that said system is adapted to support said locking arm after said second rotating movement to prevent said locking arm to rotate backwards to said locked position. By providing the system with a means to support the locking arm in an unlocked position while the connector is not yet unplugged, an operator may first unlock the connector from the counterpart and unplug or unmate them at a later convenient time. The locking system according to the invention does no longer require the complicated action for unplugging a connector, such as a cable connector, from a counterpart, such as a board connector housing or a panel. Further, when many cables are applied with cable connectors, the space to grip a cable connector may be limited. The invention allows the cable connectors to be unlocked first by activating the locking arm and then to unplug the cable connector by pulling the easy accessible cable. It is noted that the connector system according to the invention may be applied in various situations, including connections between a cable connector and a board connector housing, a cable connector and another cable connector, a board connector and another board connector etc. It is further noted that the signal transfer may relate to electrical and optical signals. It should also be appreciated that the locking arm may be part of the counterpart, i.e. the situation is reversed reading the connector as counterpart and vice-versa. If e.g. the locking arm is part of a board connector housing instead of a cable connector, the locking arm is less vulnerable to mechanical impact.

In an embodiment of the invention the connector system comprises a support structure to support said locking arm. Such a support structure can be provided in the connector and/or in the counterpart. The support structure is a reliable means to prevent the locking arm to rotate backwards to said locked position. Preferably the locking arm comprises a bent portion in the direction of said support structure to ensure that the locking arm will contact the support structure after unlocking.

In an embodiment of the invention the locking arm is shaped to contact said counterpart. The contact between a metallic locking arm and the counterpart may improve electromagnetic shielding.

In an embodiment of the invention the connector system comprises a spring member adapted to exert a biasing force to said locking arm forcing said locking arm in said locked position. The spring member provides an automatic locking action of the locking arm if the connector is plugged to the counterpart without requiring manual actuation of the locking arm. The spring member may be integrated with said locking arm and constitute e.g. a torsion spring, a spiral spring or a helical spring. The spring member may alternatively be an additional separate mounted component. Such a separate spring member is advantageous as the material of the locking arm may differ from the material of the spring member such that both elements can be optimised for their individual purposes. If e.g. a high spring force is required the construction of the spring member can be optimised for this purpose without being limited by requirements for the locking arm. The spring member further repositions the locking arm to the initial position if the system is unplugged. Moreover the internal load of the locking arm may provide an audible click if the connector is locked into the counterpart when e.g. supported by the support structure. In an embodiment of the invention the spring member may be further adapted to exert a biasing force perpendicular to a plane of said first and second rotational movement. By positioning or constructing the spring member to both exert spring forces in the rotational and sideway direction, the locking arm may contact the support structure without requiring a special shape for the locking arm. Further the sideway force may be used to absorb clearances in the system.

In an embodiment of the invention the first locking portion comprises a hook portion with a first locking surface and said second locking portion comprises a second locking surface adapted to abut said first locking surface in said locked position. Further the second locking portion may comprise a ramped surface adapted to guide a guiding surface of said first locking portion at least prior to said first rotating movement. Such a locking arrangement has proven to provide reliable automatic locking.

In an embodiment of the invention the locking arm protrudes from a housing of said connector to induce said second rotating movement. The protruding locking arm enables manual actuation of the locking arm. Alternatively the connector comprises a housing adapted to expose said locking arm in a manner that said locking arm is available to induce said second rotating movement. The housing may e.g. comprise an opening for insertion of a tool, such as a screwdriver. Preferably the locking arm can be activated by means of a structure enabling to transform rotational movement of the screwdriver to actuation of the locking arm. The rotational movement of the screwdriver does require only little space for an operator on the high density panel. Further a non-protruding locking arm reduces the chance of unintentional unlocking.

In an embodiment of the invention wherein the housing of the connector comprises a first space with an entry for a cable and a second space accommodating a part of said locking arm. The second space is preferably adapted to incorporate a shaft of or for said pivotally supported locking arm. The separated second space may protect the locking arm, especially when covered or closed by one or more walls.

In an embodiment of the invention at least one of said connector and said counterpart and said locking arm are metallic. Metallic components provide increased rigidity to the system and improve electromagnetic shielding compared to plastic housings. The locking arm may be of or comprise stainless steel. Stainless steel may be stamped and has proven to appropriately combine the characteristics of rigidity and spring function.

In an embodiment of the invention the counterpart comprises a metallic board connector housing mounted on a printed circuit board and having an entry for said locking arm to a receiving space comprising said second locking portion. Although the locking arm may lock a cable connector to a panel, preferably it locks the cable connector to a housing of the board connector to avoid adaptation of the panel for the purpose of the invention. The receiving space may further comprise at least one of said support structure and said locking surface and said ramped surface. For the metallic board connector housing e.g. diecast material can be used. Diecast material provides a considerable freedom to shape the board connector housing to the locking requirements. However, although diecast material is a preferred material, other materials such as non-diecast metal, plastic and metallized plastic may be used as well.

In an embodiment of the invention the board connector housing entry comprises one or more ground springs around said entry. The ground springs improve electromagnetic shielding effectiveness for the board connector housing in case of an unlocked or unplugged connector. Moreover the entry may comprise one or more chamfered guiding walls to facilitate insertion of the locking arm.

In an embodiment of the invention the board connector housing has a mating side for said connector, said mating side comprising at least one threaded hole. The threaded hole allows e.g. conventional cable connectors not having a pivotally supported locking arm to be locked to the board connector.

In an embodiment of the invention the connector system is adapted to allow manipulation of said locking arm to re-rotate to said locked position. This may e.g. be achieved by having a support structure that comprises a support surface with an inclined orientation or by allowing sideward movement of the locking arm to allow said locking arm to re-rotate to the locked position. Such an embodiment is advantageous since the connector does not first have to be unplugged at least partly before re-locking can be established.

The invention further relates to a cable connector for use in a connector system as described above.

The invention also relates to a counterpart, preferably a board connector housing, for use in a connector system as described above.

The invention finally relates to a method for unplugging a connector from a counterpart, said connector having a pivotally supported locking arm extending towards said counterpart adapted to lock said connector and said counterpart, comprising the steps of:

unlocking said connector by a rotating movement of said locking arm from a locked position to an unlocked position;

leaving said connector in a plugged position with said locking arm in said unlocked position without an actuating force being exerted on said locking arm;

subsequent unplugging said connector from said counterpart.

U.S. Pat. No. 5,628,648 discloses a connector position assurance system wherein an electrical connector comprises a primary locking arm with a locking slider mounted on top of the locking arm. The locking arm is locked by sliding the locking slider over the locking arm. In the unlocked position the primary locking arm is able to rotate. The disclosed system however is a complicated locking system and the locking arm is not prevented to rotate backwards to the locked position.

U.S. Pat. No. 5,154,629 discloses a cable connector with side cavities pivotally receiving latches with locking fingers for engaging a connecting element and biased into a locking position by integral leaf springs or helical compression springs. The latches however require additional sliding movement in a lateral direction and provide no support for the latch in the unlocked position.

The invention will be further illustrated with reference to the attached drawings, which show a preferred embodiment according to the invention. It will be understood that the invention is not in any way restricted to this specific and preferred embodiment.

Figure 4A:
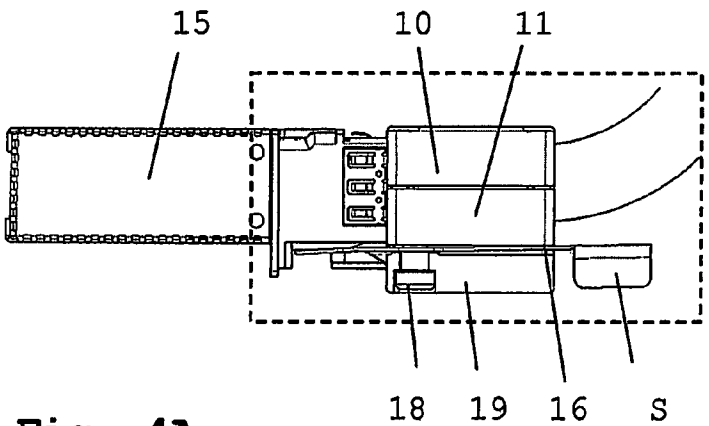
Figure 5:
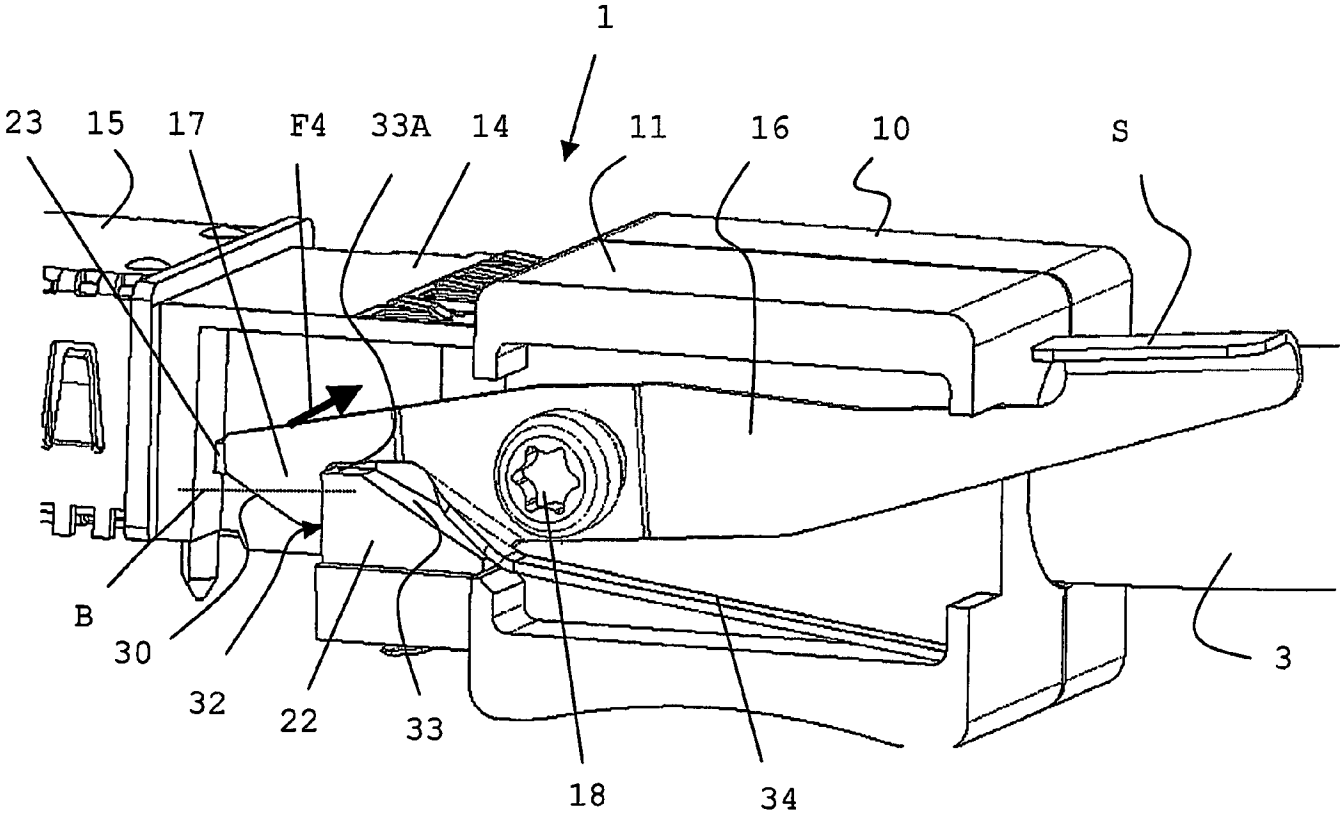
Figures 6A, 6B, 6C:
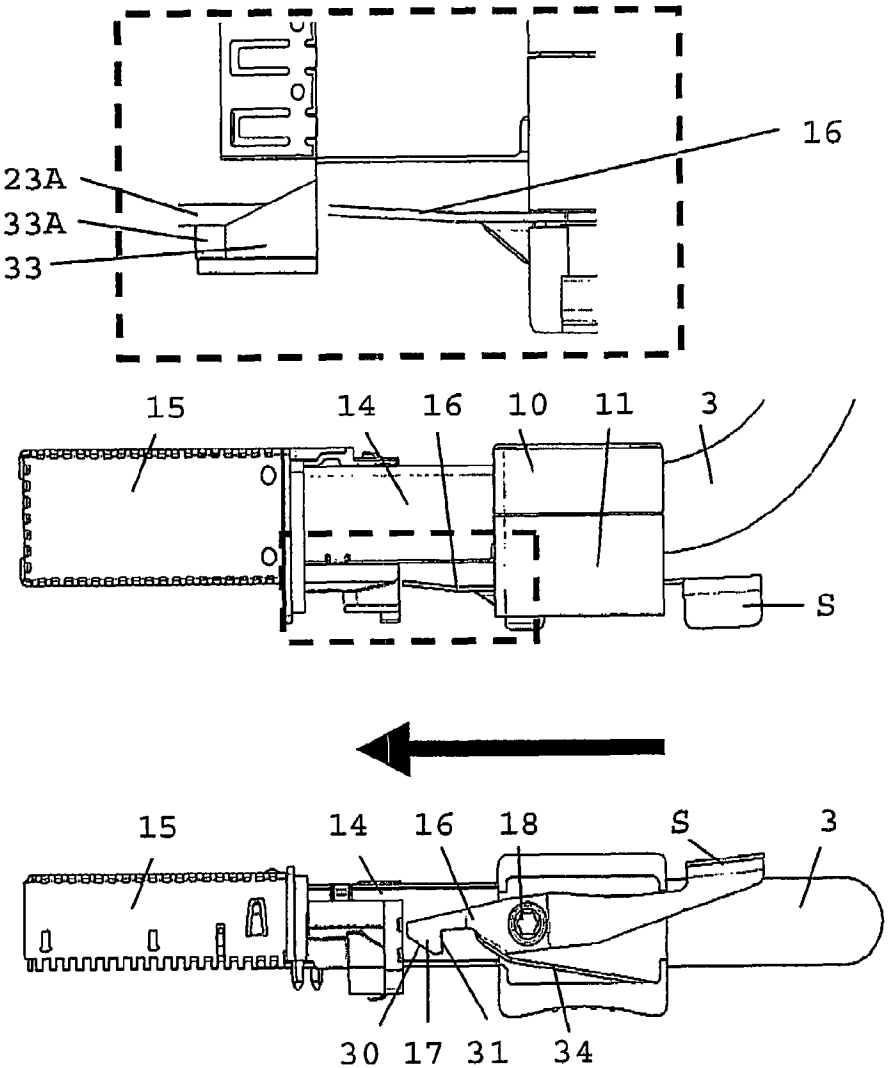
Figures 7A, 7B, 7C, 7D, 7E:
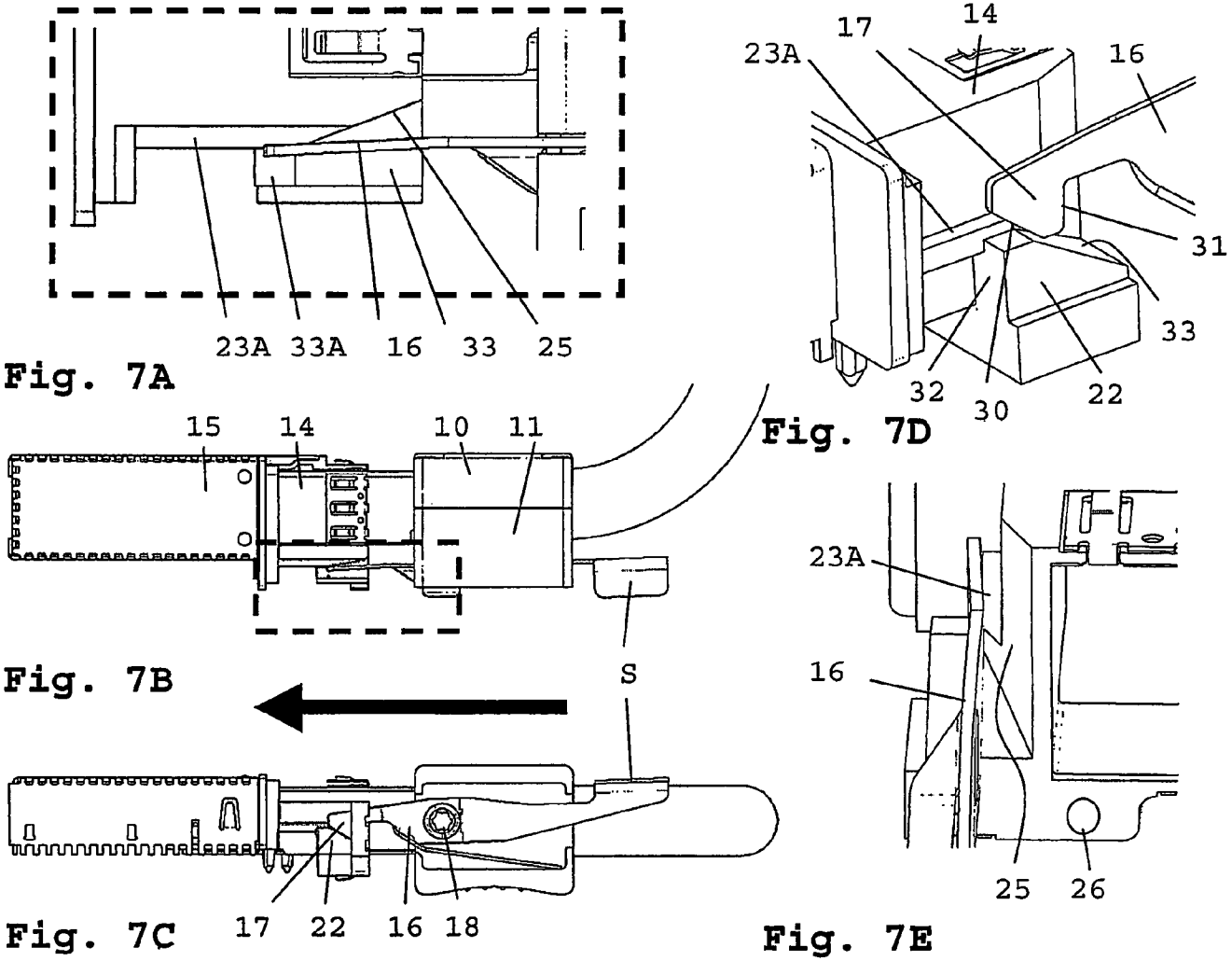
Figure 8A:
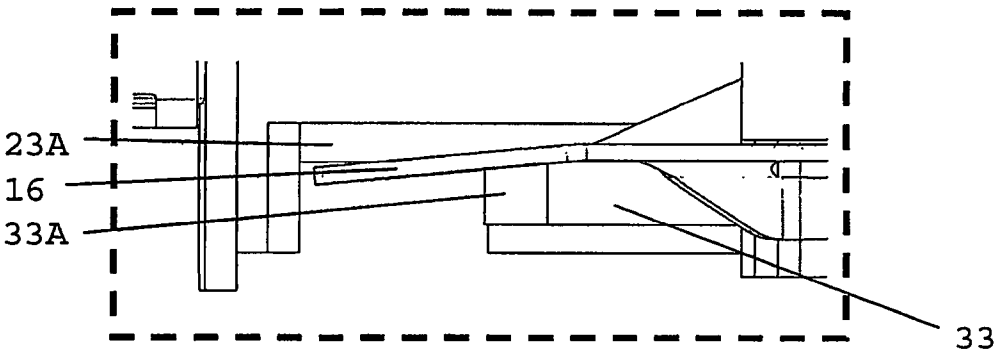
Figure 8B:
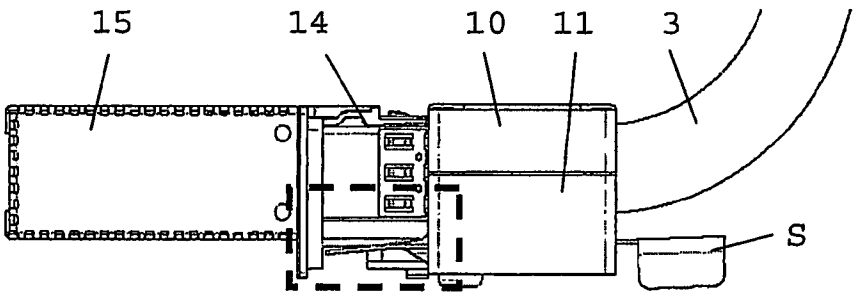
Figure 8C:
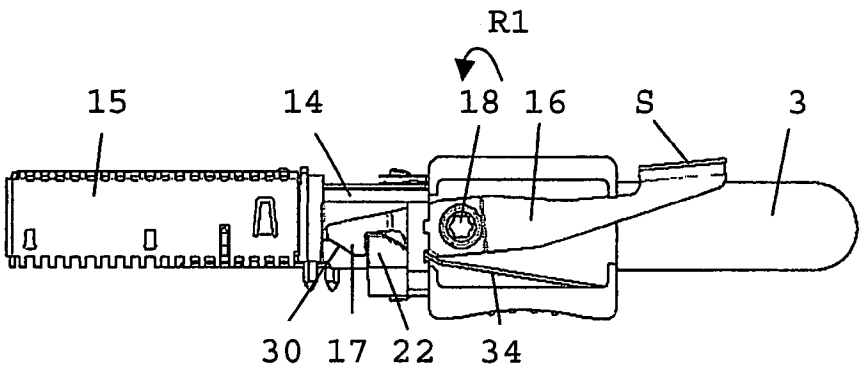
Figures 9A, 9B, 9C, 9D:
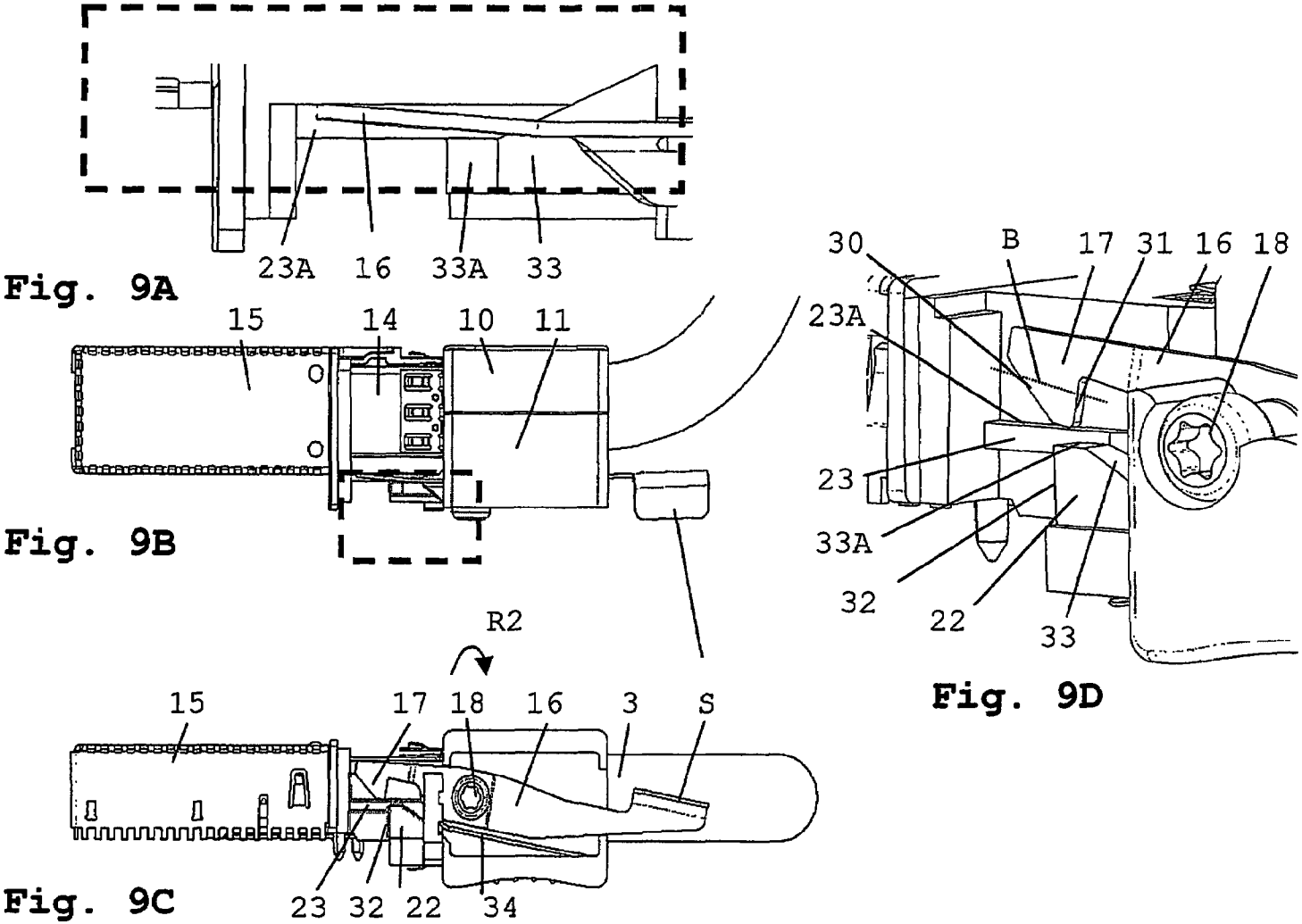
Figure 10A:
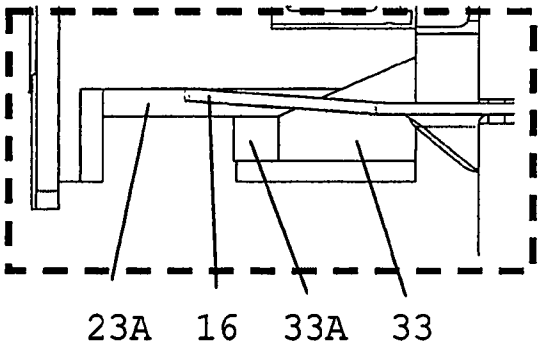
Figure 10B:
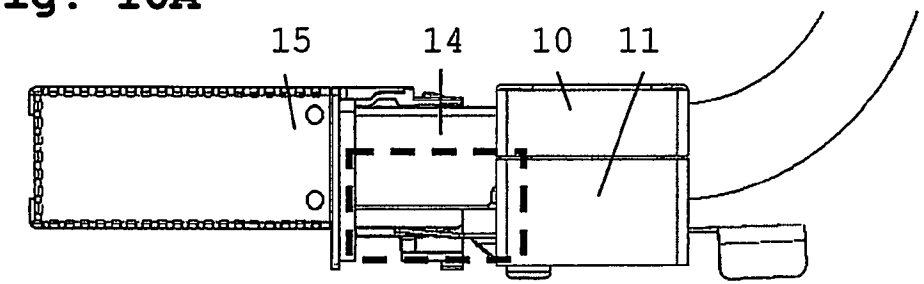
Figure 10C:
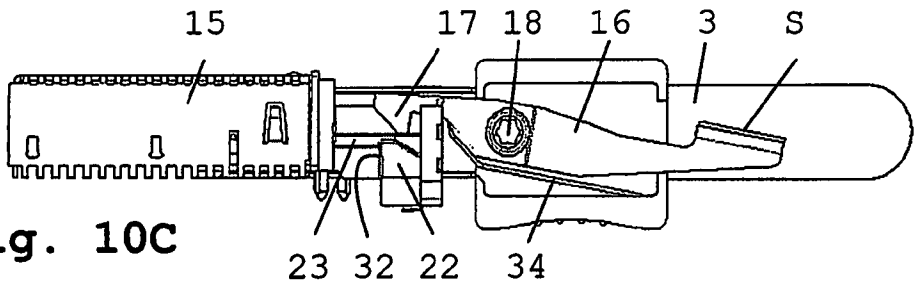
Figure 10D:
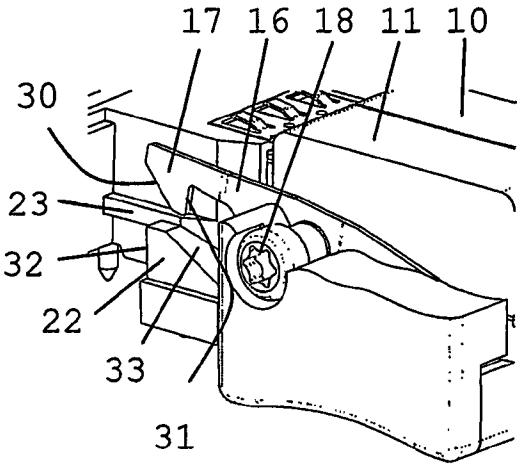
Figure 11A:
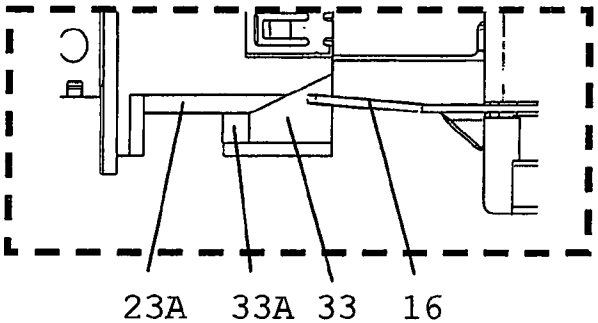
Figure 11B:
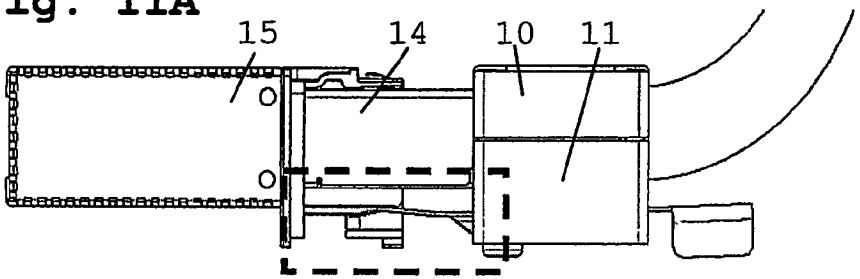
Figure 11C:
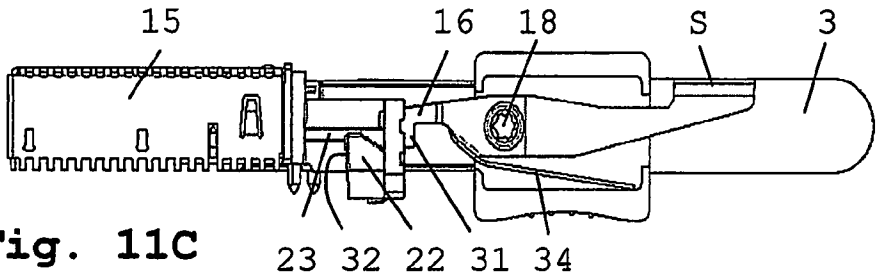
Figure 11D:
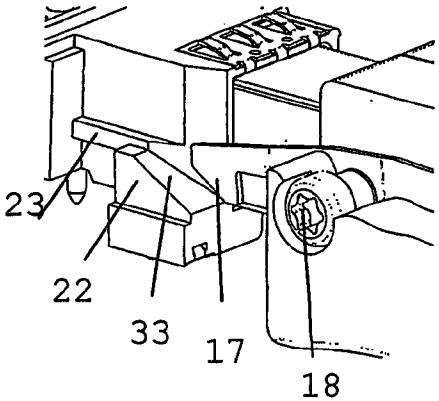
Figure 12B:
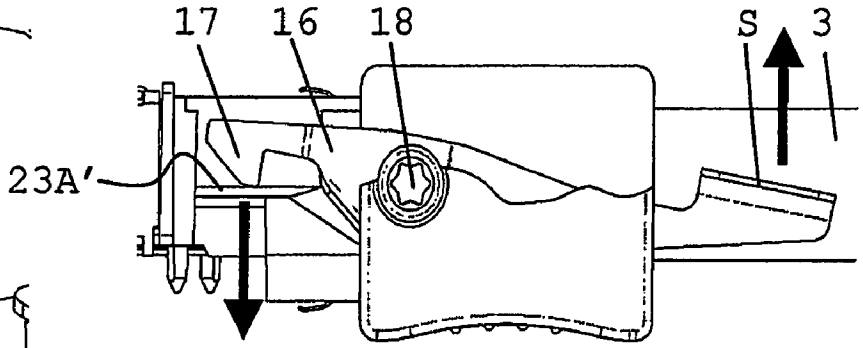
Figure 12A:
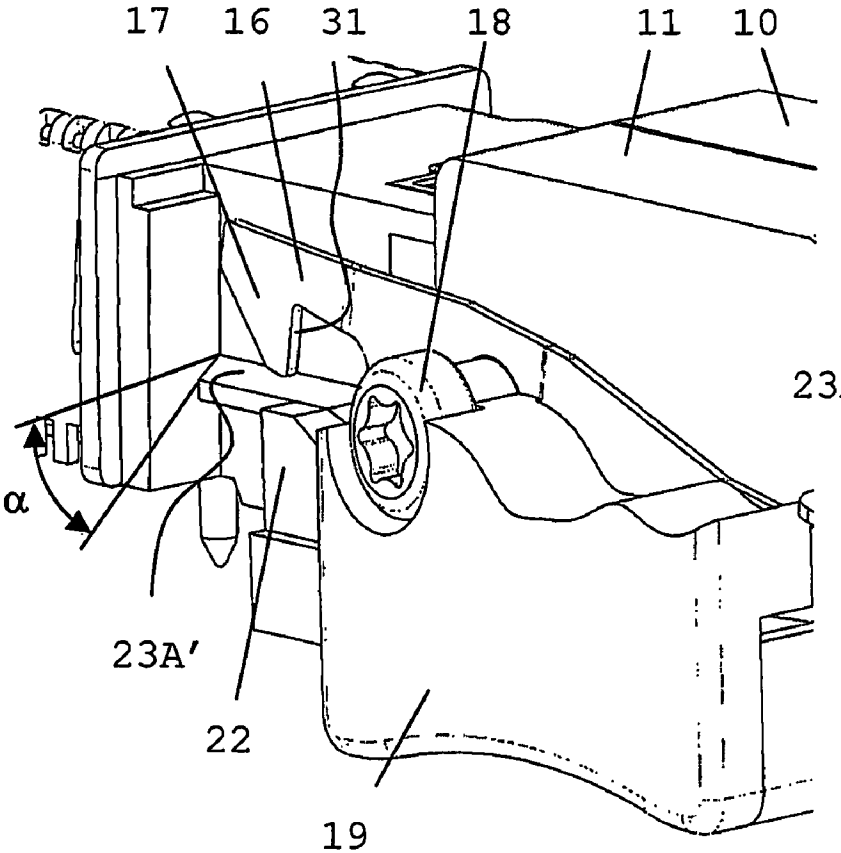

FIGS. 4A and B show detailed in-plane views of the cable connector system in a plugged and locked state according to an embodiment of the invention;

FIG. 5 shows a detailed perspective view of part of the connector system in a plugged and locked state according to an embodiment of the invention;

FIGS. 6A-6C show detailed in-plane views of a connector system according to an embodiment of the invention prior to plugging the cable connector and the board connector housing;

FIGS. 7A-7E show detailed in-plane and perspective views of a connector system according to an embodiment of the invention during plugging of the cable connector and the board connector housing;

FIGS. 8A-8C show detailed in-plane views of a connector system according to an embodiment of the invention in a locked state;

FIGS. 9A-9D show detailed in-plane and perspective views of a connector system according to an embodiment of the invention after unlocking and before unplugging of the cable connector and the board connector housing;

FIGS. 10A-10D show detailed in-plane and perspective views of a connector system according to an embodiment of the invention during unplugging of the cable connector and the board connector housing;

FIGS. 11A-11D show detailed in-plane and perspective views of a connector system according to an embodiment of the invention during unplugging of the cable connector and the board connector housing, and FIGS. 12A and 12B show detailed views of a different embodiment of the invention.

Although the invention relates to any type of connector system comprising a connector and a counterpart for the purpose of signal transfer, the invention will next be described in detail for a connector system comprising a cable connector and a board connector housing.

Figure 1:
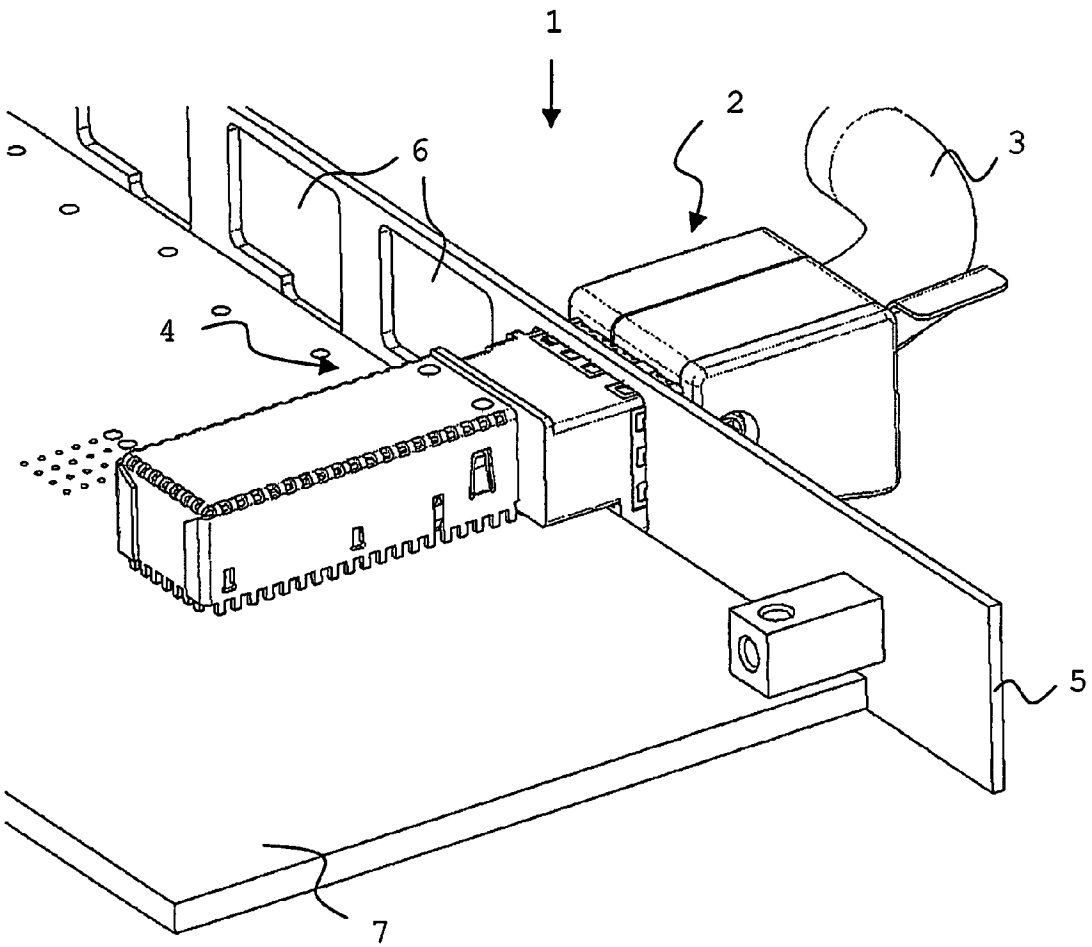
FIG. 1 shows a perspective view of connector system mounted on a circuit board attached to a front panel according to an embodiment of the invention.
Figure 2A:
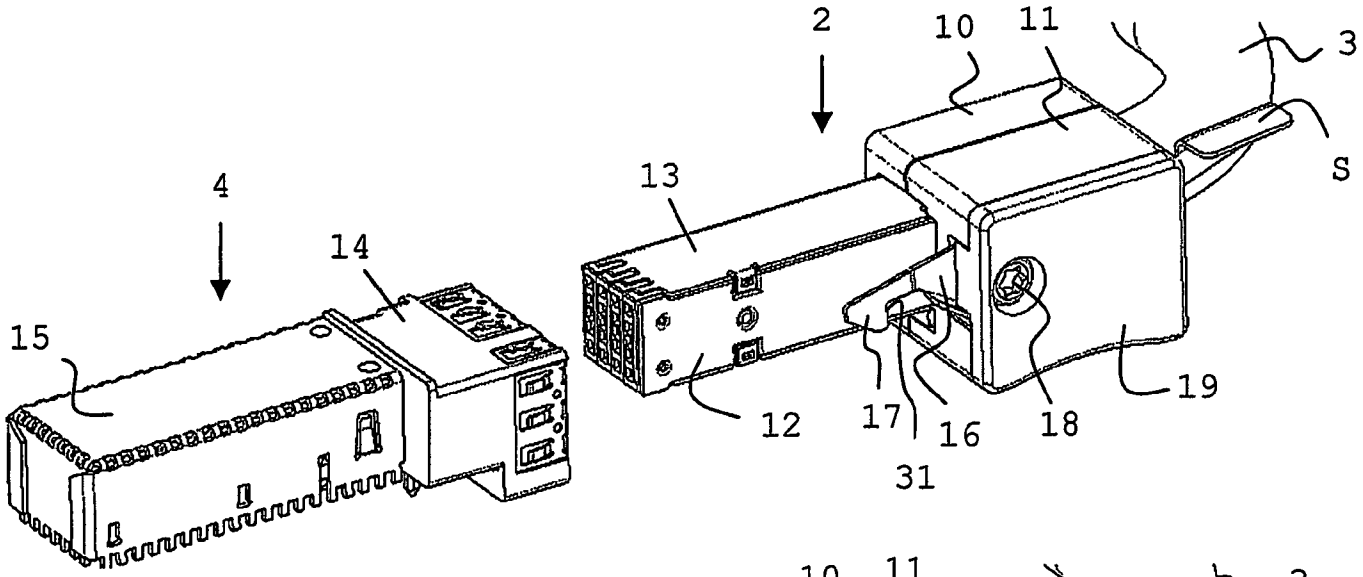
FIGS. 2A and 2B show a perspective view of the connector system of FIG. 1 in respectively an unplugged state and a plugged state.
Figure 2B:
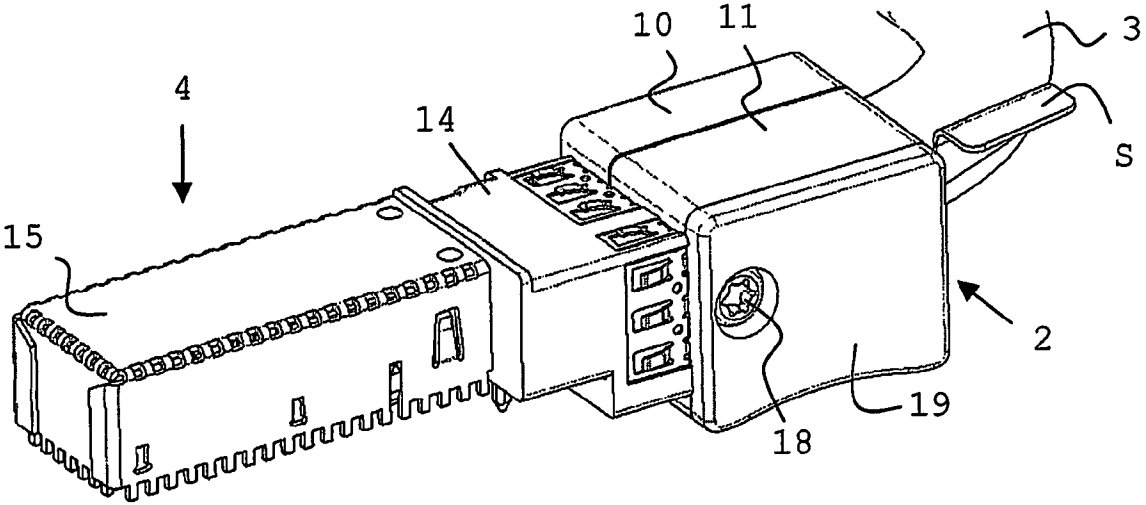
Figure 3:
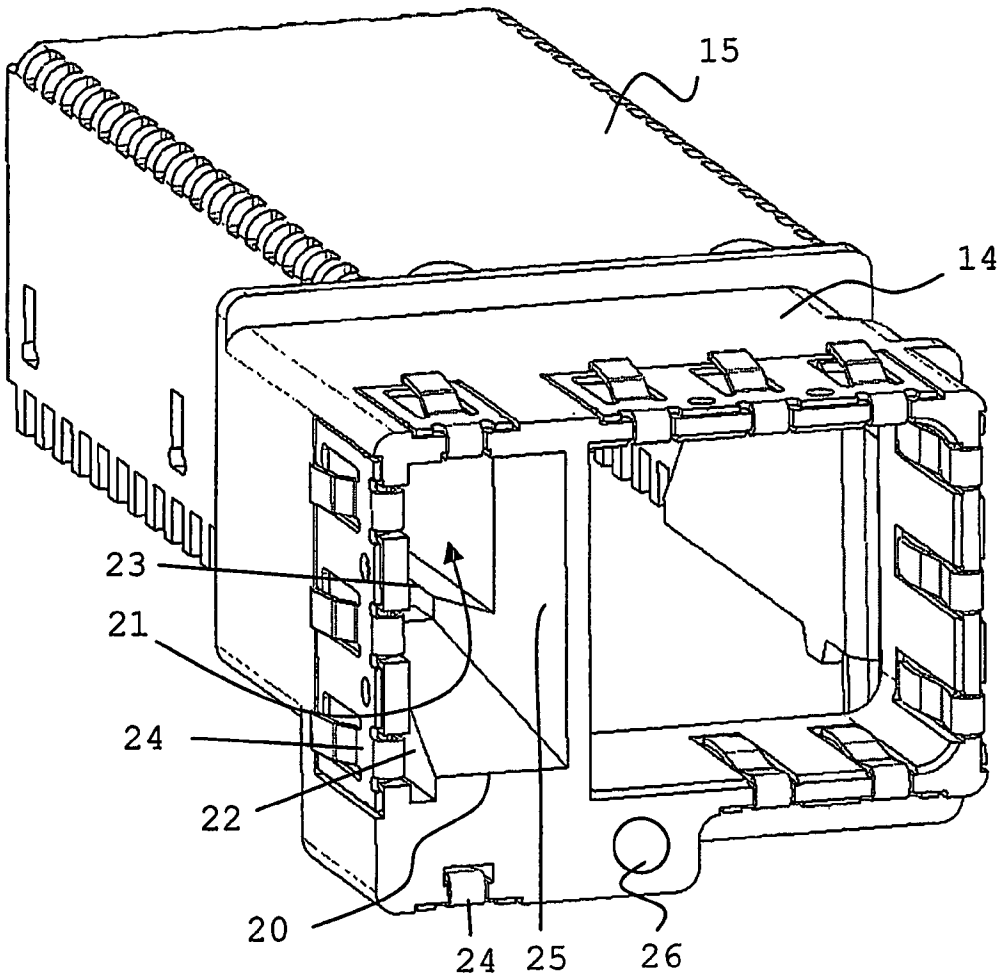
FIG. 3 shows a perspective view of a board connector housing according to an embodiment of the invention.

FIGS. 1-3 show an I/O cable connector system 1 comprising a cable connector 2 with a cable 3 and a board connector housing 4. A front panel 5 has cut-outs 6 for insertion of the cable connector 2. The front panel 5 comprises a circuit board 7, hereinafter also referred to as the PCB 7. The PCB 7 generally comprises a plurality of signal tracks and electrical components (not shown) for the transmittal of electrical signals to or from one or more wires of the cable 3. Connections of these wires to the signal tracks of the PCB 7 are obtained by providing a header arrangement (not shown) within the board connector housing 4.

The cable connector 2 comprises several parts described in detail in the pending patent application NL 1022225 ("Cable connector and method of assembling a cable to such a cable connector") of the applicant. This application is incorporated in the present application by reference with regard to the features and construction of the modular diecast metal housing parts 10, 11 providing a first space for the cable 3, the diecast metal base 12 and the sheet metal part 13 as shown in FIG. 2A and 2B and with respect to the connection of the cable 3 and termination of the wires of the cable 3 to the cable connector 2.

The board connector housing or shielding cage 4 comprises a diecast metal part 14 and a sheet metal part 15 similar to the shielding cage as described in detail in the pending patent application NL1023662 ("Shielding cage") of the applicant which is incorporated by reference in the present application with respect to the construction of the sheet metal part 15 and the manner in which the sheet metal part 15 is attached to the diecast metal part 14. Further the pending application provides information on the mounting of the diecast metal part 14 to the PCB 7.

The cable connector 2 comprises a locking arm 16 with a first locking portion 17 pivotally supported by a pivot joint 18 and extending towards the board connector housing 4 and protruding from the cable connector 2 to induce rotational movement of the locking arm 16 around the pivot joint 18. The pivot joint 18 may be formed by a fastener such as a screw, snap joint, dowel, or other type of suitable connection. The locking arm 16 may have an expanded pressing surface S for manual operation. A cover 19 is attached to the cable connector housing part 11 to provide a second space for accommodating a part of the locking arm 16. The cover 19 may be attached to the housing part 11 by means of the pivot joint 18. The pivot joint 18 may be incorporated into the cover 19. The locking arm 16 preferably is of stainless steel. Stainless steel may be stamped and has proven to combine the characteristics of adequate rigidity and resilience.

It is noted that alternatively the cable connector 2 comprises a housing adapted to expose the locking arm 16 such that said locking arm 16 is available to induce rotating movement. The housing may e.g. comprise an opening for insertion of a tool, such as a screw driver. Preferably the locking arm 16 can be activated by means of a structure (not shown) enabling to transform rotational movement of the screwdriver to actuation of the locking arm 16. The rotational movement of the screw driver does require only little space for an operator on the high density panel.

FIG. 3 shows a perspective view of the board connector housing 4. The board connector housing part 14 has an entrance 20 for the locking arm 16 to a receiving space 21. The receiving space 21 has a second locking portion 22 adapted to engage with the first locking portion 17 of the locking arm 16 by rotational movement of the locking arm 16 as will be described below in further detail. The receiving space 21 further comprises a support structure or ledge 23. The function of the support structure 23 will be described below in further detail. The entry 20 comprises ground springs 24 around said entry 20. The ground springs 24 improve electromagnetic shielding effectiveness for the board connector housing 4 in case of an unlocked or unplugged cable connector 2. Moreover the entry 20 may comprise chamfered guiding walls 25 to facilitate insertion of the locking arm 16. The board connector housing 4 may further comprise at least one threaded hole 26. The threaded hole 26 allows conventional cable connectors not having a pivotally supported locking arm 16 to be locked to the board connector 4. It should be appreciated that the board connector housing 4 may as well be a single part housing of diecast metal or any other type of convenient material. It is noted that the chamfered guiding wall 25 may positioned backwards or even omitted such that the board connector housing 4 has a single entry for the cable connector 2 and the locking arm 16. In such an embodiment the cable connector 2 may comprise an element constituting said wall when plugged into the board connector housing 4. This embodiment is e.g. advantageous as the element for the cable connector may further protect the locking arm 16, while the adapted entry of the board connector housing improves the electromagnetic shielding efficiency.

Figure 4B:
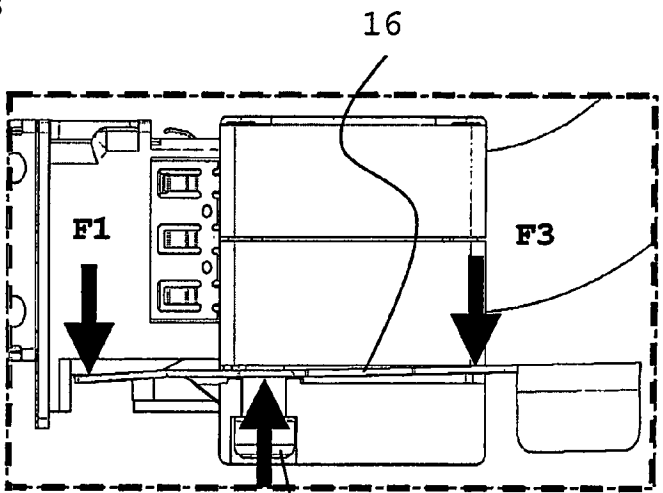

FIGS. 4A, 4B and 5 show detailed views of the connector system 1 in a plugged and locked state. FIG. 4A shows a top-view of the connector system 1, while FIG. 4B shows a detailed part of the top-view indicated by the area bounded by the dashed line.

The locking arm 16 has a first locking portion 17 in the form of a hook portion having a guiding surface 30 and a first locking surface 31, shown in FIG. 2A. The locking arm 16 is shaped to contact the board connector housing 4. If this internal spring function provides sufficient force between the locking arm 16 and the board connector housing 4, the support structure 23 shown in FIG. 3 may be omitted. Further, the contact between a metallic locking arm 16 and the housing 4 may improve electromagnetic shielding. The bold arrows in FIG. 4B show the forces on the locking arm 16. F1 is the intended pre-load on the surface of the engaged connector by the shape of the locking arm 16. F2 and F3 are the reaction forces. F2 might be adjustable, for example by tightening or loosening the screw. As the desired functioning of the locking arm 16 is subjected to tolerances and friction, the functioning can be optimised by adjusting the preload.

FIG. 5 shows a detailed perspective view of a part of the connector system 2 in the plugged and locked state of FIG. 2B, wherein the cover 19 of the cable connector 2 and a side wall of the board connector housing 4 are omitted for clarity purposes. Only a small portion of the support structure 23 is visible as it is obscured by the front portion of the locking arm 16.

The locking arm 16 has a hook portion 17 with a guiding surface 30 and a first locking surface 31 adapted to abut a second locking surface 32 of the second locking portion 22 in locked position. The second locking portion 22 further comprises a ramped surface 33 adapted to guide the guiding surface 30 of said first locking portion 17 during insertion of the locking arm 16 in the entry 20 of the receiving space 21. The lower part of the hook portion 17 may be bent towards the board connector housing 4 along the dashed line B to ensure that the locking arm 16 can be supported by the support structure 23.

Further the locking arm 16 comprises an integrated spring member or bias spring 34 to exert a biasing force to the locking arm 16 forcing said locking arm in the locked position shown in FIG. 5. The spring member 34 is supported in the second space determined by the connector housing part 11 and the cover 19. The spring member 34 further repositions the locking arm 16 to the initial position if unplugged as shown in FIG. 4B. Moreover the internal load of the locking arm 16 may provide an audible click if the connector is locked into the counterpart when e.g. supported by the support structure. As previously described the spring member 34 may alternatively be a separate spring member 34 for the locking arm 16.

The spring member may be further adapted to exert a biasing force F4 perpendicular to a plane of the first and second rotational movement R1 and R2 (see FIGS. 8 and 9). By positioning or constructing the spring member 34 to both exert spring forces in the rotational and sideway direction, the locking arm 16 may contact the support structure 23 without requiring an internal preload. Further the sideway force may be used to absorb clearances in the system.

An embodiment of the operation of the connector system 1 is illustrated in FIGS. 6-11. Identical reference number have been used to identify identical parts of the connector system 1.

FIGS. 6A-6C show detailed in-plane views of a connector system 1 prior to plugging the cable connector 2 and the board connector housing 4. The locking arm 16 has a position determined by the spring member 34 such that the guiding surface 30 will follow the ramped surface 33 of the second locking portion 22 during plugging. Clearly the locking arm 16 is bent towards the board connector housing 4 as shown in the magnified top view of FIG. 6A FIGS. 7A-7E show detailed in-plane and perspective views of a connector system 1 during plugging of the cable connector 2 and the board connector housing 4. Clearly the guiding surface 30 follows the ramped surface 33 while the locking arm 16 rotates around the pivot joint 18, as illustrated most clearly in FIGS. 7C and 7D. During this plugging rotation the hook portion 17 of the locking arm 16 is deflected outwards as the side wall of the board connector housing 4 forces the flexible locking arm 16 in this direction, as most clearly illustrated in FIG. 7E. Clearly in FIG. 7D it is shown that the side wall of the support surface 23A of the support structure 23 is elevated with respect to the flat part 33A of the ramped surface 33 such that the guiding surface 30 does not run over the support surface 23A at this stage.

If the hook portion 17 passes the last, substantially flat, part 33A of the ramped surface 33 the locking arm 16 experiences a first rotating movement R1 wherein the hook portion 17 engages with the second locking portion 22 of the board connector housing 4 to a locked position to lock said cable connector 2. FIGS. 8A-8C show detailed in-plane views of a connector system 1 where in this locked state. The hook portion 17 of the locking arm 16 clearly is deflected outwards. The spring member 34 exerts a spring force on the locking arm 16 to keep the locking arm in the locked position. Clearly from the above it can be derived that locking of the connector system can be performed by an operator only using one hand for plugging.

If the cable connector 2 and the board connector are to be unplugged, first the locked position is cancelled. FIGS. 9A-9D show detailed in-plane and perspective views of a connector system after unlocking and before unplugging the cable connector and the board connector housing. The hook portion 17 and the second locking portion 22 are disengaged by inducing a second rotating movement R2 to the locking arm 16, e.g. by manually handling of the protruding portion of the locking arm 16. The shape of the locking arm 16 and/or the hook portion 17 ensures that the locking arm 16 after said second rotating movement R2 supported by the support structure 23 and is prevented to rotate backwards to the locked position shown in FIGS. 8A-8C. The ledge 23 is preferable defined by the board connector housing 4, adjacent to the second locking portion or protrusion 22 and ramped surface 33 and spaced away from the ramped surface 33.

By providing the system with a means to support the locking arm 16 in an unlocked position while the cable connector 2 is not yet unplugged, an operator may first unlock the cable connectors 2 and unplug or unmate them at a later convenient time. Consequently the locking system according to the invention does no longer require the complicated action for unplugging a cable connector 2 from a board connector housing 4 or a panel 5 as previously described.

FIGS. 10A-10D show detailed in-plane and perspective views of a connector system during unplugging of the cable connector 2 and the board connector housing 4. Clearly the hook portion 17 is guided by the support surface 33A such that the first locking surface 31 passes the second locking surface 32 to avoid re-locking. To establish a subsequent locking the cable connector 2 and the board connector housing 4 should in this embodiment at least be unplugged to a stage wherein the hook portion 17 is no longer supported by the support surface 33A. The hook portion 17 is no longer deflected outwards.

FIGS. 11A-11D finally show detailed in-plane and perspective views of a connector system 1 during further unplugging of the cable connector and the board connector housing. In this situation the guiding surface 30 of the hook portion 17 follows the ramped surface 33 while the locking arm 16 rotates around the pivot joint 18 forced by the spring member 34.

The locking arm 16 can be attached to the first connector 2 or the second mating connector 4 or the panel 5. Similarly, the second locking portion 22, ramped surface 33, and ledge 23 can be defined by the first connector 2 or the second mating connector 4 or panel 5. Once mated, the first and second connectors 2, 4 can withstand high forces, e.g. 120N, without unlatching, as well as typical twist, bend, and pull tests.

It should be noted that various features of the above described connector system 1 can be modified within the scope of the invention, such as a modification as shown in FIGS. 12A and 12B. In this embodiment the connector system 1 is arranged such that re-locking can be performed without first having to unplug the cable connector 2. The ledge surface 23A' of the ledge 23 builds an angle a with respect to the horizontal orientation of the support surface 23A shown in FIG. 7D allowing the hook portion 17 to slip from the ledge surface to a locked position when a considerable force, indicated by the bold arrows in FIG. 12B, is applied to the locking arm 16. The angle $\alpha$ may be varied to optimise the forces for unintended and intended return of the locking arm 16 to the locked position. It is thus noted that in the embodiment of FIG. 12, the feature of the invention wherein the locking arm 16 is prevented to rotate backwards to said locked position should be interpreted such that the locking arm is substantially prevented to rotate backwards, as by an intended action the locking arm 16 can re-rotate to the locked position in this embodiment. It should be appreciated that other embodiments to perform this re-locking function can be envisaged such as those wherein the locking arm 16 comprises a bump corresponding to a recess, hole or groove in the support structure 23. Also the system 1 may be adapted to allow the locking arm 16 or at least the hook portion 17 a sideward movement, such that the hook portion 17 comes off the support structure 23 and the locking arm 16 re-rotates to the locked position.

Further it is noted that other modifications of the embodiments shown fall within the scope of the invention, including embodiments wherein the locking arm 16 is mounted on the board connector, the application of further spring members 34, embodiments wherein the board connector housing 4 comprises only a single space for both the cable connector 2 and the locking arm 16 and embodiments wherein more than one locking arm 16 is applied for a connector system 1, e.g. mounted on a single cable connector 2.

The invention claimed is:

1. Connector system of a connector and a counterpart, said connector comprising a pivotally supported locking arm extending towards said counterpart, wherein said locking arm comprises a first locking portion adapted to engage with a second locking portion of said counterpart by a first rotating movement (R1) of said locking arm to a locked position to lock said connector and said counterpart and adapted to disengage from said second locking portion by a second rotating movement (R2) to an unlocked position to unlock said connector and said counterpart characterized in that said first locking portion is configured to deflect in a direction angled relative to said first and second rotational movements, and said system is adapted to support said locking arm after said second rotating movement (R2) to prevent said locking arm to rotate backwards to said locked position.

2. Connector system according to claim 1, wherein said locking arm is shaped to contact said counterpart.

3. Connector system according to claim 1, wherein said first locking portion comprises a hook portion with a first locking surface and said second locking portion comprises a second locking surface adapted to abut said first locking surface in said locked position.

4. Connector system according to claim 1, wherein said connector comprises a housing adapted to expose said locking arm such that said locking arm is available to induce said second rotating movement (R2).

5. Connector system according to claim 1, wherein at least one of said connector and said counterpart comprises a support structure to support said locking arm.

6. Connector system according to claim 5, wherein said locking arm comprises at least a bent portion (B) in the direction of said support structure.

7. Connector system according to claim 1, wherein said system comprises a spring member adapted to exert a biasing force to said locking arm forcing said locking arm in said locked position.

8. Connector system according to claim 7, wherein said spring member is integrated with said locking arm.

9. Connector system according to claim 1, wherein said locking arm protrudes from a housing of said connector to induce said second rotating movement (R2).

10. Connector system according to claim 9, wherein said housing comprises a first space with an entry for a cable and a second space accommodating a part of said locking arm.

11. Connector system according to claim 10, wherein said second space is adapted to incorporate a pivot joint of or for said pivotally supported locking arm.

12. Connector system according to claim 1, wherein at least one of said connector and said counterpart and said locking arm are metallic.

13. Connector system according to claim 12, wherein said locking arm comprises stainless steel.

14. Connector system according to claim 1, wherein said counterpart comprises a metallic board connector housing mounted on a printed circuit board having an entry for said locking arm to a receiving space comprising said second locking portion.

15. Connector system according to claim 14, wherein said entry is part of an entry for said connector.

16. Connector system according to claim 14, wherein said receiving space further comprises at least one of said support structure and said second locking surface and said ramped surface.

17. Connector system according to claim 14, wherein said board connector housing entry comprises one or more ground springs around said entry.

18. Connector system according to claim 14, wherein said board connector housing entry comprises one or more chamfered guiding walls for said locking arm.

19. Connector system according to claim 14, wherein said board connector housing has a mating side for said connector, said mating side comprising at least one threaded hole.

20. Connector system according to claim 1, wherein said system is adapted to allow manipulation of said locking arm to re-rotate to said locked position.

21. Connector system according to claim 20, wherein said support structure comprises a support surface with an inclined orientation (a) to allow said locking arm to re-rotate to said locked position.

22. Connector system according to claim 20, wherein said system is adapted to allow sideward movement of said locking arm to allow said locking arm to re-rotate to said locked position.

23. Cable connector for use in a connector system according to claim 1 comprising a housing with at least housing part forming a first space with an entry for a cable and second space for said locking arm.

24. Cable connector according to claim 23, wherein said second space is formed by a cover attached to said housing part.

25. Counterpart for use in a connector system according to claim 1, wherein said counterpart is a board connector housing with at least a portion containing an entry for said cable connector and an entry to a receiving space comprising said second locking portion.

26. Counterpart according to claim 25, wherein said entry to said receiving space comprises one or more ground springs around said entry.

27. Connector system of a connector and a counterpart, said connector comprising a pivotally supported locking arm extending towards said counterpart, wherein said locking arm comprises a first locking portion adapted to engage with a second locking portion of said counterpart by a first rotating movement (R1) of said locking arm to a locked position to lock said connector and said counterpart and to disengage from said second locking portion by a second rotating movement (R2) to an unlocked position to unlock said connector and said counterpart characterized in that said system is adapted to support said locking arm after said second rotating movement (R2) to prevent said locking arm to rotate backwards to said locked position, wherein said system comprises a spring member adapted to exert a biasing force to said locking arm forcing said locking arm in said locked position, wherein said spring member is a separate spring element for said locking arm.

28. Connector system of a connector and a counterpart, said connector comprising a pivotally supported locking arm extending towards said counterpart, wherein said locking arm comprises a first locking portion adapted to engage with a second locking portion of said counterpart by a first rotating movement (R1) of said locking arm to a locked position to lock said connector and said counterpart and to disengage from said second locking portion by a second rotating movement (R2) to an unlocked position to unlock said connector and said counterpart characterized in that said system is adapted to support said locking arm after said second rotating movement (R2) to prevent said locking arm to rotate backwards to said locked position, wherein said system comprises a spring member adapted to exert a biasing force to said locking arm forcing said locking arm in said locked position, wherein said spring member is further adapted to exert a biasing force perpendicular to a plane of said first and second rotating movement (R1,R2).

29. Connector system of a connector and a counterpart, said connector comprising a pivotally supported locking arm extending towards said counterpart, wherein said locking arm comprises a first locking portion adapted to engage with a second locking portion of said counterpart by a first rotating movement (R1) of said locking arm to a locked position to lock said connector and said counterpart and to disengage from said second locking portion by a second rotating movement (R2) to an unlocked position to unlock said connector and said counterpart characterized in that said system is adapted to support said locking arm after said second rotating movement (R2) to prevent said locking arm to rotate backwards to said locked position, wherein said second locking portion comprises a ramped surface adapted to guide a guiding surface of said first locking portion at least prior to said first rotating movement (R1).

30. Method for unplugging a connector from a counterpart, said connector having a pivotally supported locking arm extending towards said counterpart adapted to lock said connector and said counterpart, comprising the steps of:

unlocking said connector by a rotating movement of said locking arm from a locked position and a subsequent second angled movement of said locking arm relative to said rotating movement to an unlocked position;

leaving said connector in a plugged position with said locking arm in said unlocked position without an actuating force being exerted on said locking arm;

subsequent unplugging of said connector from said counterpart.

31. Connector system of a connector and a counterpart, said connector comprising a pivotally supported locking arm, wherein said locking arm comprises a first locking portion adapted to engage with a second locking portion of said counterpart by a first rotating movement of said locking arm to a locked position to thereby lock said connector and said counterpart, wherein when said first locking portion is disengaged from said second locking portion said first locking portion is configured to automatically deflect in a direction angled relative to a path of said first rotating movement, wherein said system is configured to support said first locking portion after said first locking portion deflects in the direction angled relative to the path of said first rotating movement to thereby prevent said locking arm from rotating back towards said locked position.

* * * * *